US005163303A

United States Patent [19]

Miyata et al.

[11] Patent Number: 5,163,303

[45] Date of Patent: Nov. 17, 1992

[54] DOUBLE-WALLED TUBE TYPE OPEN RACK EVAPORATING DEVICE

[75] Inventors: Yoshiaki Miyata, Yokohama; Masakazu Hanamure, Shinagawa; Takahide Yamamotao, Yokohama; Youji Satoh, Minosi; Masaru Akiyama, Soraku, all of Japan

[73] Assignees: Tokyo Gas Co. Ltd., Tokyo; Sumitomo Precision Products Co. Ltd., Hyogo, both of Japan

[21] Appl. No.: 677,469

[22] Filed: Mar. 29, 1991

[30] Foreign Application Priority Data

Mar. 30, 1990 [JP] Japan ..... 2-86373
Mar. 30, 1990 [JP] Japan ..... 2-86374
Mar. 30, 1990 [JP] Japan ..... 2-86376

[51] Int. Cl.[5] ..... 62 527; F17C 9/02
[52] U.S. Cl. ..... 62/50.2
[58] Field of Search ..... 62/50.2, 527

[56] References Cited

U.S. PATENT DOCUMENTS 4,343,156 8/1982 Gauthier ..... 62/50.2
4,395,976 8/1983 de Lallee et al. ..... 62/50.2

FOREIGN PATENT DOCUMENTS 0043300 3/1984 Japan .
1254241 8/1986 U.S.S.R. .

*Primary Examiner*—Ronald C. Capossela
*Attorney, Agent, or Firm*—Watson, Cole, Grindle & Watson

[57] ABSTRACT

A double-walled tube type open rack evaporating device comprising a plurality of heat-exchanging pipes each of a double-walled tube structure having an inner tube and an outer tube in communication with the inner pipe at one end to constitute a heat-exchanging panel, a liquefied gas inlet header tank connected to one end of the inner tube, an exit header tank connected to one end of the outer tube, and a heating means for gradually evaporating a liquefied gas that flows from the liquefied gas inlet header tank into the inner tube and then delivering the gas as a gas at a normal temperature to the exit header tank. Deposition of ice can be avoided and the amount of sea water used as a heat medium can be reduced to save electric power consumption in a sea water pump. Flow rate and calorie hunting can be prevented to make LNG and NG flows stable.

6 Claims, 12 Drawing Sheets

PRIOR ART

DOUBLE-WALLED TUBE TYPE OPEN RACK EVAPORATING DEVICE

BACKGROUND OF THE INVENTION

1. Field of the Invention

The present invention concerns a double-walled tube type open rack evaporating device and, more in particular, it relates to a double-walled tube type open rack evaporating device for evaporating a liquefied natural gas by using a heat medium.

2. Description of the Prior Art

As an open rack type evaporating device for evaporating a liquefied natural gas (hereinafter simply referred to as LNG) by using a heat medium such as sea water, a single-tube open rack type evaporating device has been used predominantly so far.

A single type open rack type evaporating device has a structure as shown in FIG. 12, in which a heat-exchanging panel 1 is formed by disposing a plurality of single tube heat-exchanging pipes in parallel. LNG is supplied from a lower header tank 2 disposed to the lower end of the panel 1. As LNG uprises in the pipes, it is evaporated under heating with sea water as a heat medium sprayed from troughs 3, 3 disposed on both sides above the heat-exchanging panel and then supplied externally as a natural gas (hereinafter referred to as NG) from an upper header tank 4 disposed to the upper end of the heat-exchanging panel 1.

The single tube open rack type evaporating device has a simple structure as described above and can be manufactured with ease. However, since heat-exchange is conducted directly between sea water as the heat medium and LNG at a cryogenic temperature through walls of the single tubes of the heat-exchanging panel 1, ice is deposited and increased to the outside of the pipes, that is, at the surface of the heat-exchanging panel 1.

Referring more specifically, if the flow rate of water supplied by spraying to each of the heat exchanging pipes of the heat-exchanging panel is localized, the height of ice deposited to the outer surface of the pipes becomes irregular. The degree of irregularity of the ice deposition is increased along with the increase of the LNG flow rate.

As a result, the temperature for each of the heat-exchanging pipes themselves becomes not uniform to cause difference in the shrinkage in each of the heat-exchanging pipes, to increase the thermal stresses, so that improvement for the performance as the evaporating device greatly suffers from restriction.

In view of the above, for preventing such irregular ice deposition to the surface of the heat-exchanging panel 1, it has been proposed a means, for example, of making the water spray amount uniform for each of the heat-exchanging pipes or moderating thermal stresses, but the fundamental drawback of the single tube type open rack evaporating device can not yet be overcome.

As a method of dissolving the problem, although it may be considered such a constitution of using a double-walled tube type structure for the heat-exchanging pipes to heat LNG indirectly, this brings about various problems, for example, the heat conduction efficiency is poor and the temperature of NG is lowered by LNG at a cryogenic temperature and supply of a gas at a normal temperature needs heating of a low temperature gas after leaving the evaporating device. No optimum constitution for an LNG evaporating device has yet been proposed in view of the selection for the position of disposing header tanks and troughs, method of utilizing a passage between the inner tube and the outer tube, considering the heat conduction efficiency.

OBJECT OF THE PRESENT INVENTION

It is, accordingly, an object of the present invention to provide an evaporating device having heat-exchanging pipes of a double-walled tube structure in order to reduce ice deposition to the surface of a heat-exchanging panel which is a drawback in the conventional single tube open rack type evaporating device.

Another and more specific object of the present invention is to provide a double-walled tube type open rack evaporating device intended for preventing the hunting of flow rate, reduction of ice deposition, reduction for the amount of sea water and stabilization of a gas flow.

SUMMARY OF THE INVENTION

As a fundamental aspect of the present invention, there is provided a double-walled tube open type rack evaporating device comprising a plurality of heat-exchanging pipes each of a double-walled tube structure having an inner tube and an outer tube in communication with the inner pipe at one end to constitute a heat-exchanging panel, a liquefied gas inlet header tank connected to one end of the inner tube, an exit header tank connected to one end of the outer tube, and a heating means for gradually evaporating a liquefied gas that flows from the liquefied gas inlet header tank into the inner tube and then delivering the gas as a gas at a normal temperature to the exit header tank.

As a second aspect of the present invention, there is provided a double-walled tube type open rack evaporating device, wherein a plurality of heat-exchanging pipes each of a double-walled tube structure are disposed in parallel to constitute a heat-exchanging panel, and a water spray trough is disposed to the upper portion of the panel for enabling heating, a liquefied gas is introduced from an inlet header tank disposed on the side of the upper or the lower end of the heat-exchanging pipe into an inner tube, a fluid leaving the inner tube can reverse its flowing direction in an outer tube closed at the other end on the side opposite to the inlet header tank, heat exchange is enabled between a fluid flowing upwardly or downwardly through an annular passage between the outer tube and the inner tube after reversing its flowing direction and sprayed water at the outer surface of the outer tube and the liquefied gas in the inner tube, and the gas evaporated and heated can be delivered from an exit header tank connected to the outer tube on the side of the inlet header tank.

As a third aspect of the present invention, there is provided a double-walled tube type open rack evaporating device, wherein a heat-exchanging panel is formed by disposing a plurality of heat-exchanging pipes each of a double-walled tube structure in parallel, in which an inner tube shorter than an outer tube is coaxially inserted into the outer tube closed at one end and having an exit header tank disposed at the other end thereof such that the opening end of the inner tube is opposed to the closing end of the outer tube, and the closing end of the inner tube connected with the inlet header tank is situated at a position spaced apart by a predetermined distance from the exit header tank, the heat-exchanging panel is disposed vertically with the header tank being situated above or below, and water spray troughs are disposed to the upper portion of the panel for enabling heating, a liquefied gas is introduced from the inlet header tank connected with the closing end of the inner tube into the inner tube, and a fluid leaving the inner tube in the closed outer tube can reverse its flowing direction, heat-exchange is enabled between a fluid flowing upwardly or downwardly through an annular passage between the outer tube and the inner tube, and sprayed water to the outer surface of the outer tube and the liquefied gas in the inner tube, and the liquefied gas is delivered from the exit header tank connected with the end of the outer tube.

As a fourth aspect of the present invention, there is provided a double-walled tube type open rack evaporating device, wherein a heat-exchanging panel is formed by disposing a plurality of heat-exchanging pipes each of a double-walled tube structure in parallel, a liquefied gas inlet header tank and a an evaporated exit header tank are disposed to the outer or the lower portion of the heat-exchanging·panel and a water spray trough is disposed to the upper portion of the panel, and a liquefied gas is caused to flow from one end of the inner tube and an evaporated gas reversed its flowing direction at the opening and of the inner tube opposed to the closing end of the outer tube is delivered by moving through an annular passage between the outer tube inner tube, or the liquefied gas is caused to flow from one end of the inner tube, and enabled for gas-liquid mixing in the outer tube through small apertures disposed in the outer circumference at the other closing end of the inner tube, in which a heat conduction promoter is inserted to either of the inner tube and the annular passage.

Various embodiments may be considered for the double-walled tube type open rack evaporating device according to the present invention and referring more specifically to one embodiment thereof, it comprises a constitution wherein a liquefied gas is introduced from an inlet header tank disposed on the upper end or the lower end of a heat exchanging pipe of a heat-exchanging panel into an inner tube, gas-liquid mixing is enabled in the outer tube through small apertures disposed at the outer circumference of the inner tube on the side of the other of the closing end opposite to the inlet header tank, heat exchange is enabled between a fluid flowing upwardly and downwardly in an annular passage between the outer tube and the inner tube, and sprayed water at the surface of the outer tube and the liquefied gas in the inner tube, and an evaporated and heated gas can be delivered from an exit header tank connected to the outer tube on the side of the inlet header tank, in which a heat conduction promoter is inserted to either of the inner tube or the annular passage.

As a fifth aspect of the present invention, there is provided a constitution, wherein a heat-exchanging panel is formed by disposing a plurality of heat-exchanging pipes each of a double-walled tube structure in parallel, in which an inner tube shorter than an outer tube is coaxially inserted into the outer tube closed at one end and having an exit header tank disposed at the other end such that the opening end of the inner tube is opposed to the closing end of the outer tube, and the closing end of the inner tube connected with an inlet header tank is situated at a position spaced apart by a predetermined distance from the exit header tank, the heat-exchanging panel is disposed vertically with the header tank being situated above or below, and water spray troughs are disposed to the upper portion of the panel for enabling heating, a liquefied gas is introduced from the inlet header tank connected to the closing end of the inner tube into the inner tube, gas-liquid mixing is enabled in the outer tube by means of small apertures disposed to the outer circumference of the other closing end of the inner tube, heat-exchange is enabled between a fluid flowing upwardly or downwardly through an annular passage between the outer tube and the inner tube, and sprayed water to the outer surface of the outer tube and the liquefied gas in the inner tube, and the liquefied gas is delivered from the exit header tank connected with the end of the outer tube, in which a heat conduction promoter is inserted to either of the inner tube and the annular passage.

As a result of various studies with an aim of providing a double-walled tube type open rack evaporating device capable of reducing ice deposition to an LNG inlet header tank, which caused problems in the conventional open rack type evaporating device, the first aspect of the present invention lies in heat-exchanging pipes of a double-walled tube structure comprising an inner tube and an outer tube in communication at one end thereof to the inner tube, a liquid gas inlet header tank connected with one end of the inner tube of the heat-exchanging pipe, an exit header tank connected to one end of the outer tube and a heating means for gradually evaporating a liquefied gas flowing from the gas inlet header tank into the inner tube and then delivering the gas as a gas at a normal temperature to the exit header tank.

Accordingly, the heating means gradually evaporates a liquefied gas through a flow channel of: inlet header tank-inner tube-outer tube-exit header tank, and NG at a normal temperature can be obtained in a stable flow of LNG and NG under the state of reducing the ice deposition, decreasing the amount of heat medium (sea water) and in a state of preventing flow rate and calorie hunting. In this case, various kind of methods are applicable as for the heating means, for example, use of water spray troughs.

As a result of various studies with an aim of providing a double-walled tube type open rack evaporating device capable of reducing ice deposition to an LNG inlet header tank, which caused problems in the conventional open rack type evaporating device, it has been found possible, in the second aspect of the present invention, to attain an evaporating device capable of reducing ice deposition which has been inevitable in the conventional device, decreasing the amount of sea water, saving the electric power of water pumps and preventing flow rate hunting and calorie hunting and stabilizing LNG and NG flows, by a constitution of forming a heat-exchanging panel by disposing a plurality of heat-exchanging pipes each of a double-walled tube structure, disposing an LNG inlet header tank and an NG exit header tank on one side in the upper or the lower portion of the heat-exchanging pipe, and heat as: sea water-outer tube-NG-inner tube-LNG through U-shaped flow of reversing the flowing direction of LNG introduced and caused to flow downwardly from one end to the inner tube at the other end, moving LNG between the outer tube and the inner tube and then flowing to the NG exit header tank of the outer tube.

In this embodiment, various structures can be employed for the double-walled tube structure, for example, one end of the inner tube may protrude from the outer tube, providing that LNG can be caused to flow downwardly from the upper end of the inner tube, reverse its flowing direction at the lower opening end while NG can flow upwardly through an annular passage between the outer tube and the inner tube, or the LNG can be caused to flow from the lower end of the inner tube upwardly, reverse its flowing direction at the upper opening end while NG can flow downwardly through the annular passage between the outer pipe and the inner tube.

Further, a tube with fins having star fins protruded to the outer circumferential surface of the outer tube can be used. Furthermore, recesses or unevenness may be disposed to the inner surface both for the inner tube and the outer tube to increase the heat conduction area.

In addition, the header tank is disposed on one side of the upper or the lower portion of the heat-exchanging pipe of a double-walled tube structure such that a fluid can be caused to flow through a U-shaped flow channel from the inner tube to the outer tube. For instance, in a case where the LNG inlet is disposed to the upper end of the inner tube, the NG exit may be situated at any position so long as it is on the upper side of the heat-exchanging panel.

In this embodiment, any of constitution may be employed for the water spray trough so long as sea water can be sprayed such that it flows downwardly along the outer circumferential surface of the outer tube from the upper portion of the heat-exchanging panel. It is at least necessary to dispose the trough such that water is not sprayed to the LNG inlet header tank and it may be disposed in accordance with the position for each of the header tanks.

In this embodiment, it is necessary that the heat insulator covering the outer circumferential surface of the upper portion of the inner tube is disposed such that NG delivered is not cooled by LNG just after introduction. Known heat insulating material such as bakelite or stainless steel may be used and the position and range for the covering, the amount, etc. can be selected properly in accordance with conditions such as the double-walled tube structure, position for the inlet header tank and the position for the NG exit as described above.

As a result of various studies with an aim for providing a double-walled tube type open rack evaporating device capable of reducing ice deposition to an LNG inlet header as in the conventional open rack type evaporating device, it has been found possible, in the third aspect of the present invention, to attain an evaporating device capable of reducing ice deposition which was inevitable so far in the conventional device, reducing the amount of sea water, saving the electric power of water pumps, preventing the flow rate and calorie hunting and stabilizing LNG and NG flows, by a constitution of forming a heat-exchanging panel by disposing a plurality of heat-exchanging pipes each of a double-walled tube structure in parallel, in which an upper end of an inner tube is disposed at a position lower than an upper end of an outer tube, disposing an NG exit header tank to an upper end portion of the heat-exchanging panel, and entering heat as: sea water-water tube-NG-inner tube-LNG through a U-shaped flow of reversing the flowing direction of LNG introduced and caused to flow downwardly from an LNG inlet header tank disposed at a position lower than the NG exit header tank to the inner tube at the other end, moving it between the outer tube and the inner tube and then flowing to the NG exit header tank of the outer tube.

In this embodiment, any of structure can be employed for the double-walled tube structure, providing that LNG can be caused to flow downwardly from the upper end of the inner tube, reverse its flowing direction at the lower opening end while NG can flow upwardly through an annular passage between the outer tube and the inner tube, or the LNG can be caused to flow from the lower end of the inner tube upwardly, reverse its flowing direction at the upper opening end while NG can flow downwardly through the annular passage between the outer pipe and the inner tube.

Further, a tube with fins having star fins protruded to the outer circumferential surface of the outer tube can be used. Furthermore, recesses or unevenness may be disposed to the inner surface both for the inner tube and the outer tube to increase the heat conduction area.

In this embodiment, the header tank is disposed on one side of the upper or the lower portion of the heat-exchanging pipe of a double-walled tube structure such that a fluid can be caused to flow through a U-shaped flow channel from the inner tube to the outer tube. It is necessary that the NG exit header tank is disposed to the upper end or the lower end portion of the outer tube, and the LNG inlet header tank is disposed spaced apart by a required distance from the NG exit for sufficiently heating NG cooled by LNG just after introduction. The exit header tank may be disposed at any position so long as it situates in the upper or the lower portion from the center of the heat-exchanging panel.

Further in this embodiment, any of constitution may be employed for the water spray trough, so long as sea water can be sprayed such that it flows downward along the outer circumferential surface of the outer tube from the upper portion of the heat-exchanging panel. However, it is at least necessary that the trough be disposed such that water is not sprayed to the LNG inlet header tank and the trough may be disposed in accordance with the position for each of the header tanks. Further, the connection pipes to the LNG inlet header tank and the inner tube are desirably applied with a heat insulating treatment by using known heat insulating materials such as bakelite and stainless steels.

As a result of various studies with an aim of attaining an open rack type evaporating device of a double-walled tube structure capable of reducing ice deposition to a heat-exchanging panel as in the conventional open rack type evaporating device, it has been fund possible, in the fourth and fifth aspects according to the present invention, to attain an evaporating device having a heat-exchanging panel formed by disposing a plurality of heat-exchanging pipes each of a double-walled tube structure inserted with a heat conduction promoter, in which a liquefied gas is caused to flow from one end of an inner tube and an evaporated gas reversed its flowing direction at the opening end of the inner tube opposed to the closing end of the outer tube is moved through an annular passage between the outer tube and the inner tube and then delivered or the liquefied gas is caused to flow from one end of the inner tube and enabled for gas/liquid mixing in the outer tube through small apertures disposed to the outer circumferential surface at the other closing end of the inner tube, and the liquefied gas is passed through the annular passage between the outer tube and the inner tube and then delivered, thereby capable of reducing the ice deposition which was inevitable in the conventional device, reducing the amount of sea water, saving the electric power of water pumps, preventing flow rate and calorie hunting and stabilizing LNG and NG flows.

In the embodiments described above, any of structure may be employed for the double-walled tube structure, for example, such that the upper end of the inner tube protrudes from the upper pipe or NG is delivered from the upper end of the outer tube disposed at a position higher than the upper end of the inner tube, so long as LNG is caused to from one end of the inner tube, and reverses its flowing direction at the opening end or LNG and NG are mixed through small apertures disposed to the outer circumference or the like of the other closing end, and NG can be delivered by passing through the annular channel between the outer pipe and the inner tube.

Further, a tube with fins having star fins protruded to the outer circumferential surface of the outer tube can be used. Furthermore, recesses or unevenness may be disposed to the inner surface both for the inner tube and the outer tube to increase the heat conduction area.

In the embodiments described above, a spiral heat conduction promoter is inserted into the pipe, which causes stirring and turbulence to promote the heat conduction, and twisting pitch, configuration and the like can be selected depending on the desired heat exchanging efficiency or the like.

In this embodiment, if the LNG inlet of the header tank is disposed to the end of the double-walled tube, the NG exit may be at any position so long as it is situated on the side of the LNG inlet.

Further, in a case of disposing the NG exit header tank to the upper end of the outer tube, the LNG inlet header tank is disposed so as to be aparted by a predetermined distance from the NG exit in order to sufficiently heat NG cooled by LNG just after introduction, but it may be situated at any position so long as it is on the upper side from the central portion of the heat-exchanging panel.

In the embodiments described above, any of constitution may be employed for the water spray trough so long as sea water can be sprayed such that it flows downwardly along the outer circumferential surface of the outer tube from the upper portion of the heat-exchanging panel. It is at least necessary to dispose the trough such that water is not sprayed to the LNG inlet header tank and it may be disposed in accordance with the position for each of the header tanks.

In this embodiment, it is necessary that the heat insulator covering the outer circumferential surface of the upper portion of the inner tube is disposed such that NG delivered is not cooled by LNG just after introduction. Known heat insulating material such as bakelite or stainless steel may be used and the position and range for the covering, the amount, etc. can be selected properly in accordance with conditions such as the double-walled tube structure, position for the inlet header tank and the position for the NG exit as described above.

DESCRIPTION OF THE ACCOMPANYING DRAWINGS

These and other objects, as well as advantageous features of the present invention will become apparent by reading detailed descriptions for the preferred embodiments according to the present invention with reference to the accompanying drawings, wherein FIG. 1 through FIG. 9 are, respectively, explanatory views for the vertical cross sections illustrating preferred embodiments of a double-walled tube type open rack evaporating device according to the present invention;

FIG. 1*a* is a partially enlarged vertical sectional view showing an another embodiment of the invention as shown in FIG. 1.

FIGS. 10 and 11 are graphic diagrams illustrating the temperature for each of sea water, LNG and NG depending on the difference in the height of a heat-exchanging panel; and FIG. 12 is an explanatory perspective view for a single tube type open rack evaporating device.

DESCRIPTION OF PREFERRED EMBODIMENTS

FIG. 1 through FIG. 9 are, respectively, explanatory views for the vertical cross sections illustrating preferred embodiments of the double-walled tube type open rack evaporating device according to the present invention.

EXAMPLE 1

Figure 1:
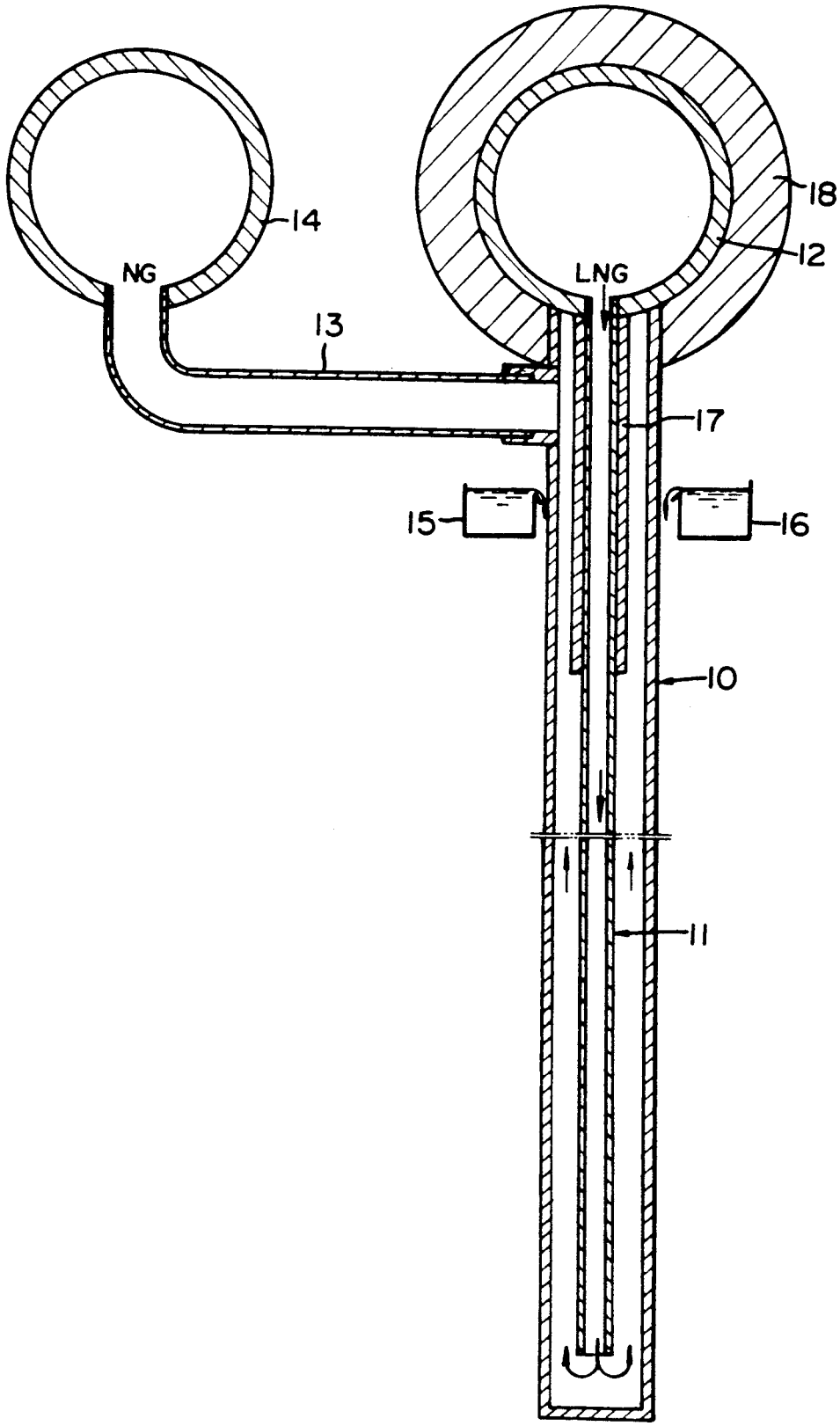
Figure 1A:
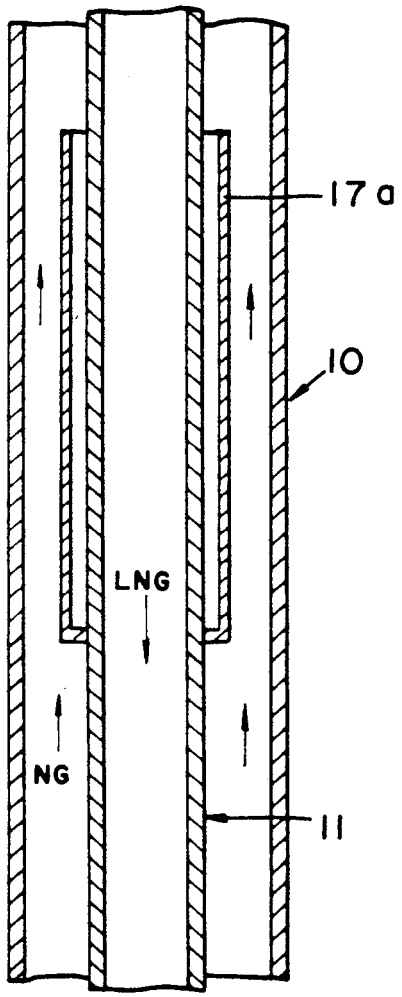

FIG. 1 shows a double-walled tube type open rack evaporating device as one preferred embodiment according to the present invention, in which a plurality of heat-exchanging pipes each of a double-walled tube structure are arranged in parallel to constitute a heat-exchanging panel disposed vertically. An LNG inlet header tank and an NG exit header tank are disposed above the panel 1.

Each of the heat-exchanging pipes has an outer tube 10 of predetermined length and inner diameter and closed at a lower end and an inner tube 11 inserted therein, in which the lower end opening of the inner tube 11 is situated to the inner bottom of the outer tube 10, while the upper end of the inner tube 11 is connected with an LNG inlet header tank 12 for allowing LNG to be introduced and flow downwardly, and the upper end of the outer tube 10 is closed by the header tank 12.

An NG exit header tank 14 is disposed by way of an NG exit pipe 13 connected to the outer tube 10 below the LNG inlet header tank 12. Water overflown from water spray troughs 15, 16 opposed to each other below the NG exit pipe 13 and below the LNG inlet header tank 12 on the opposite side to the outer surface for each outer tube 10 consitituting the heat-exchanging panel.

Further, the inner tube 11 is covered with a heat insulator 17 at its outer circumferential surface over a predetermined length from the junction with the LNG inlet header tank 12 to a position below the water spray troughs 15, 16 below the NG exit pipe 13. The LNG inlet header tank 12 is also covered with a heat insulator 18.

LNG supplied is partially evaporated under heating with NG to be described later while it flows downwardly from the inlet header tank 12 through the inner tube 11 till it leaves the lower end opening of the inner tube 11 and reverses its flowing direction at the inner bottom of the outer tube 10.

The partially evaporated LNG is heated further during its uprising through an annular passage between the outer tube 10 and the inner tube 11 and it is delivered by way of the NG exit pipe 13 connected to the upper portion of the outer tube 10 to the NG exit header tank 14 as NG at a normal temperature.

In the open rack type evaporating device of this embodiment, since the heat-exchanging pipe is constituted with a double-walled tube, sea water as a heat medium and LNG at a cryogenic temperature conduct heat exchange not directly but by way of NG in the annular passage and, accordingly, ice deposition to the surface of the outer tube 10 can be reduced and the size of the evaporating device can be decreased due to the increase of the heat conduction area.

Accordingly, since the ice deposition is reduced, the amount of sea water as the heat medium to be supplied can be decreased, which enables to remarkably save the amount of electric power consumed by a sea water pump.

Further, since the LNG inlet header tank 12 for supplying LNG at a cryogenic temperature is situated higher than the troughs 15, 16, it is possible to hinder the heat of sea water from intruding to the LNG inlet header tank 12, and the flow rate hunting and calorie hunting to each of heat-exchanging pipes can be prevented.

Further, since the heat-exchanging pipe is constituted with a double-walled pipe, NG can be supplied in a U-shaped flow channel in which NG is supplied from the lower end of the inner tube 11 into the outer tube 10, uprises in the pipe and then exits externally from the upper end, so that a pressure loss in the pipe is increased to stabilize the gas flow.

Furthermore, in the open rack type evaporating device in this embodiment, the inner tube 11, to which LNG at a cryogenic temperature is supplied from the LNG header tank 12 is covered for the required upper portion thereof with the heat insulator 17 to prevent lowering of the temperature of NG near the NG exit disposed in adjacent therewith.

Figure 10:
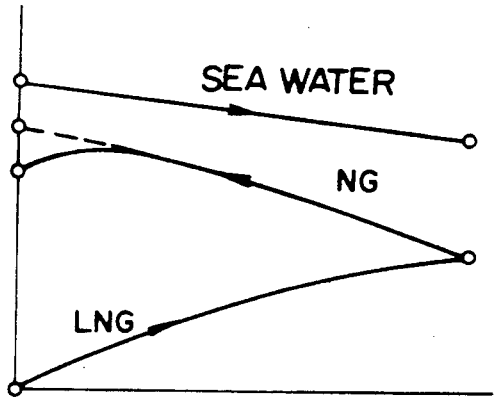
Figure 11:
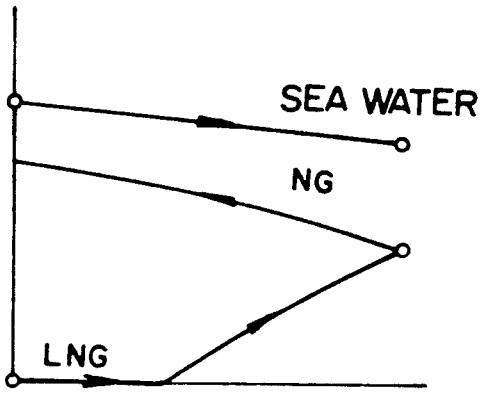
Figure 12:
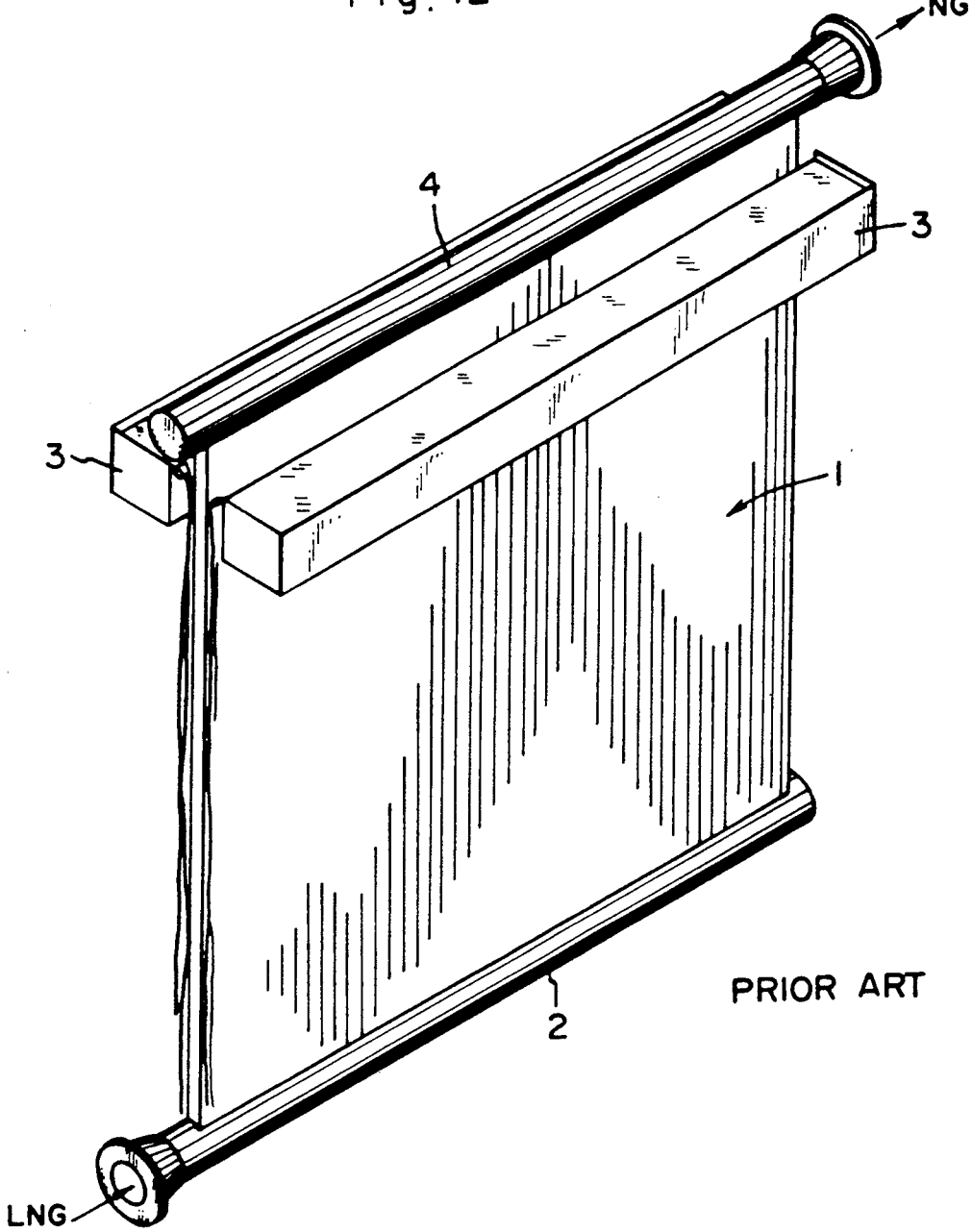

Referring more specifically, in the open rack type evaporating device having the constitution as shown in FIG. 1, the temperature of NG is lowered near the NG exit pipe 13 when the insulator 17 disposed for the required upper portion of the inner tube 11 is removed as shown in FIG. 10, whereas the temperature of NG is elevated as far as a temperature approximate to that of sea water if the insulator 17 is covered as shown in FIG. 11.

Alternatively to the insulator 17 covering the outer periphery of the upper portion of the inner tube 11, a cover 17*a* may be disposed around the outer periphery of the inner tube 11 in such a manner as to form a predetermined space between the cover and the inner tube so that the space may function as a gas reservoir accommodating a portion of NG derived from LNG thereby preventing the NG from being cooled.

For the above heat insulating cover 17*a* any formation can be adopted, if it is formed to accommodate a portion of NG derived from LNG. For example, the cover may be formed with varying an opening ratio between an inlet side and an outlet side of the cover to enable NG to stay therein for a short while and any known material such as aluminum, thermosetting resins, stainless steel or likes may be used for formation of the cover which is to be secured to the inner tube 11 by welding or bolting.

EXAMPLE 2

Figure 2:
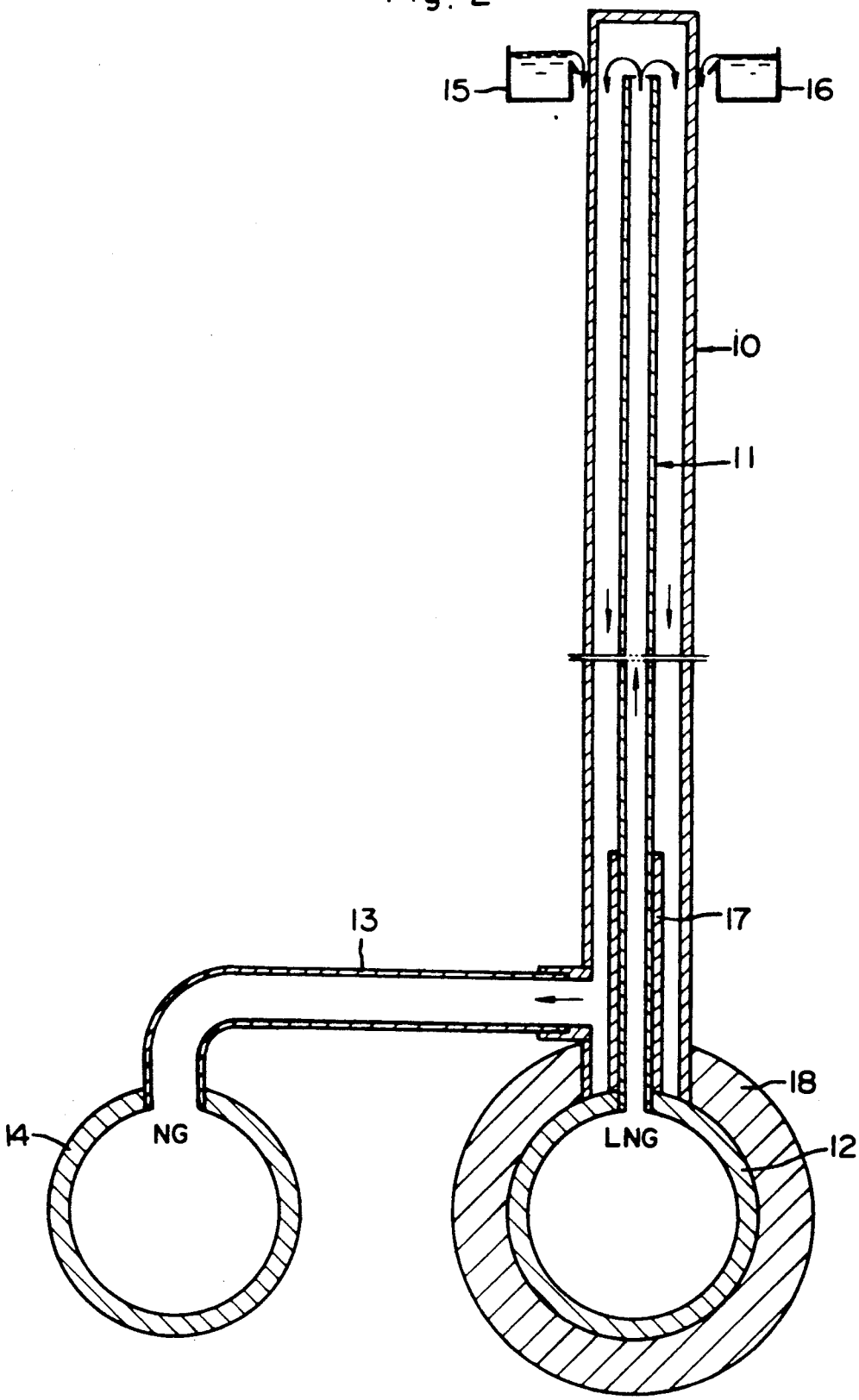

FIG. 2 shows another embodiment of a double-walled tube type open rack evaporating device according to the present invention, in which a heat-exchanging panel having the same constitution as that previously described with reference to FIG. 1 is disposed upside-down, that is, an LNG header tank 12 is disposed at the lower end of the panel, an NG exit header tank 14 is disposed therealong in the same way, while no header tanks are disposed at all near the water spray troughs 15, 16 disposed in the upper portion of the panel.

LNG supplied is partially evaporated under heating with NG to be described later while it uprises from the inlet header tank 12 in the inner tube 11 till it leaves the upper end opening of the inner tube 11 and reverses its flowing direction in the upper end of the outer tube 10.

The partially evaporated LNG is further heated while it flows downwardly through an annular passage between the outer tube 10 and the inner tube 11 and is then delivered by way of an NG exit pipe 13 connected below the outer pipe 10 to the NG exit header tank 14 as NG at a normal temperature.

Since the heat-exchanging panel having the same constitution as that shown in FIG. 1 is used upside-down, substantially the same effects can be obtained.

EXAMPLE 3

Figure 3:
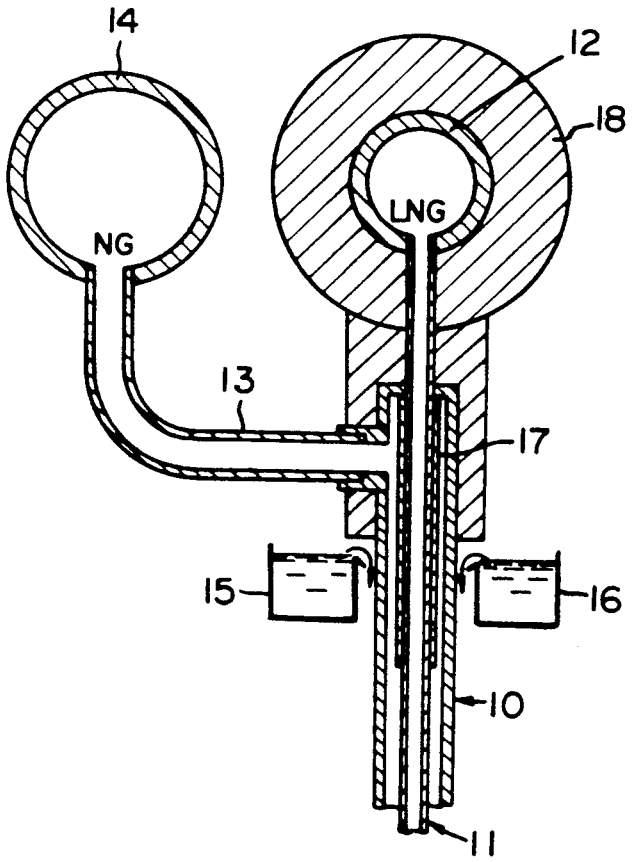
Figure 4:
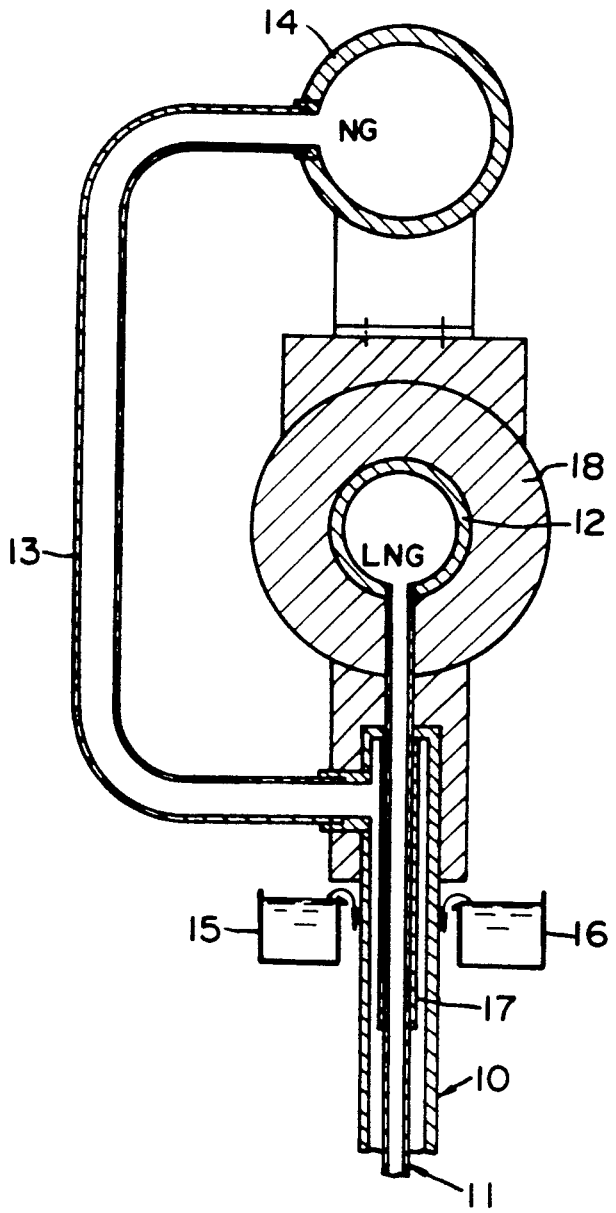

FIG. 3 and FIG. 4 each shows a further embodiment of a double-walled tube type open rack evaporating device according to the present invention and the illustrated device has the same constitution as that previously described with reference to FIG. 1 and can provide similar effects, excepting that the upper end of an inner tube 11 is protruded from the closed upper end of an outer tube 10 and the upper end of the inner tube 11 is covered with a heat insulator 17, and that an NG exit header tank 14 is situated above an LNG inlet header tank 12 in the embodiment shown in FIG. 4, while an NG exit header tank 14 is situated substantially at the same height as that for the LNG inlet header tank 12 in the embodiment shown in FIG. 3.

EXAMPLE 4

Figure 5:
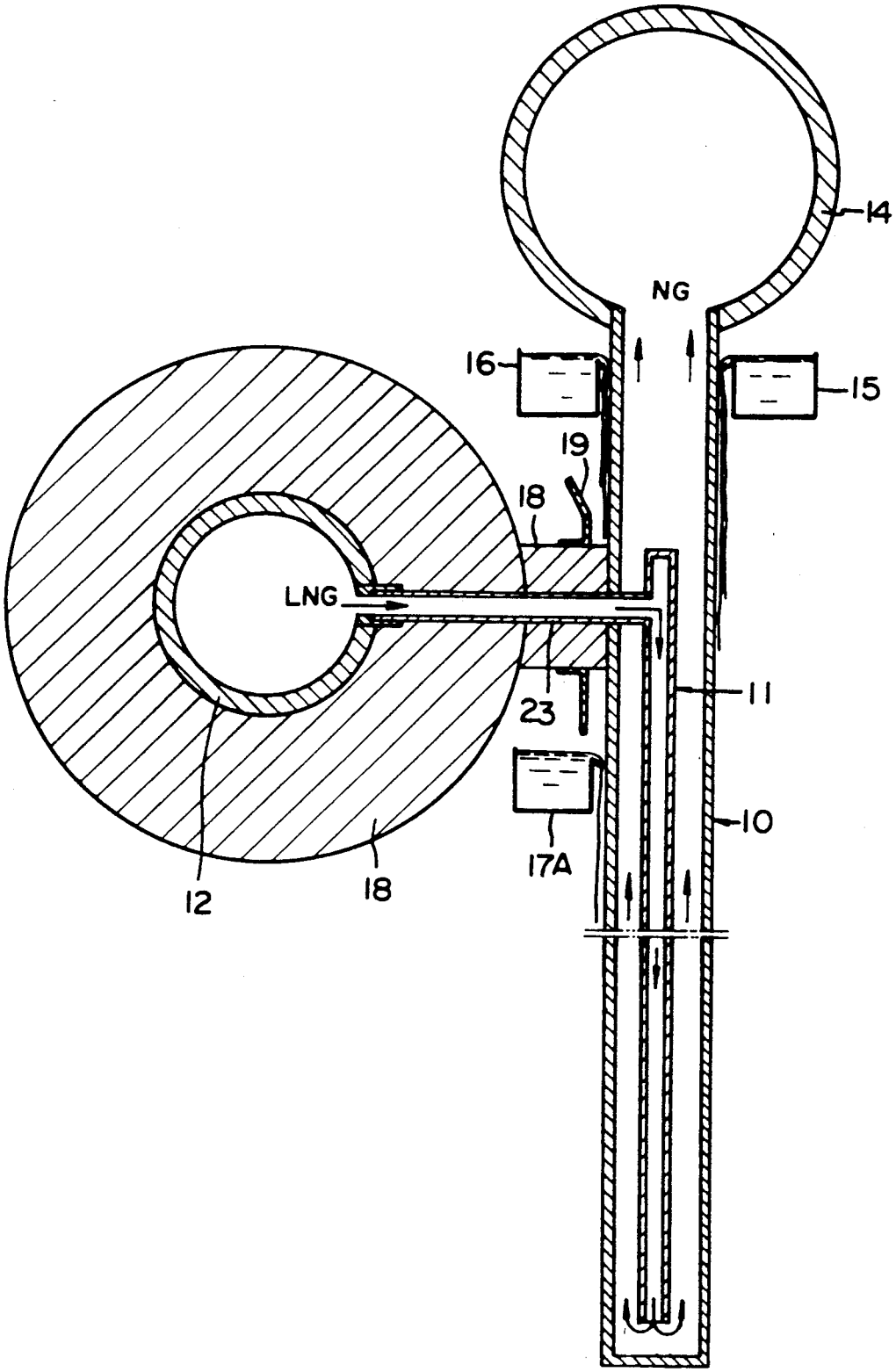

FIG. 5 shows a further embodiment of a double-walled tube type open rack evaporating device according to the present invention, in which a plurality of heat-exchange pipes of a double-walled tube structure are arranged in parallel, to constitute a heat-exchanging panel disposed vertically. An LNG inlet header tank and an NG exit header tank are disposed to the upper portion of the panel.

Each of heat-exchanging pipes comprises an outer tube 10 of predetermined length and inner diameter and closed at the lower end thereof and an inner tube 11 shorter than the outer tube 10 and inserted into the outer pipe 10. The lower end opening of the inner tube 11 is situated to the inner bottom of the outer tube 10, while the upper end of the inner tube 11 is situated while being spaced apart below by a predetermined distance from the upper end of the outer tube 10, and the upper end of the outer pipe 10 is connected with an NG exit header tank 14, so that NG can be delivered.

An LNG inlet header tank 12 is disposed at a predetermined position below the NG exit header tank 14 by way of an LNG inlet pipe 23 connected passing through the outer tube 10 to the upper portion of the inner tube 11.

The LNG inlet pipe 23 and the LNG inlet header tank 12 are entirely covered with a heat insulator 18.

Water overflown from water spray troughs 15, 16 disposed opposed to each other below the NG exit header tank 14 flows downwardly along the outer surface of each of the outer tubes 10 constituting the heat-exchanging panel, while water overflown from a water spray trough 17A also flows below the LNG inlet pipe 23.

Further, a scattering preventive plate 19 is disposed circumferentially on the heat insulator 18 for the LNG inlet pipe 23 such that water overflown from the water spray trough 16 below the NG exit header tank 14 is not sprayed on the side of the LNG inlet header tank 12.

LNG supplied is partially evaporated under heating with NG to be described later while it flows downwardly from the inlet header tank 12 through the inner tube 11 till it leaves the lower end opening of the inner tube 11 and reverses its flowing direction at the inner bottom of the outer tube 10.

The partially evaporated LNG is heated further during its uprising through an annular passage between the outer tube 10 and the inner tube 11 and it is delivered to the NG exit header tank 14 connected to the upper end of the outer tube 10 as NG at a normal temperature.

In the open rack type evaporating device of this embodiment, since the heat-exchanging pipe is constituted with a double-walled tube, sea water as a heat medium and LNG at a cryogenic temperature conduct heat exchange not directly but by way of NG in the annular passage and, accordingly, ice deposition to the surface of the outer tube 10 can be reduced and the size of the evaporating device can be decreased due to the increase of the heat conduction area.

Accordingly, since the ice deposition is reduced, the amount of sea water as the heat medium to be supplied can be decreased, which enables to remarkably save the amount of electric power consumed by a sea water pump.

Further, since the LNG inlet header tank 12 for supplying LNG at a cryogenic temperature is situated higher than the troughs 15, 16, it is possible to hinder the heat of sea water from intruding to the LNG inlet header tank 12, and the flow rate hunting and the calorie hunting to each of heat exchanging pipes can be prevented.

Further, since the heat-exchanging pipe is constituted with a double-walled pipe, NG can be supplied in a U-shaped flow channel in which NG is supplied from the lower end of the inner tube 11 into the outer tube 10, uprises in the pipe and then exits externally from the upper end, so that a pressure loss in the pipe is increased to stabilize the gas flow.

Furthermore, in the open rack type evaporating device in this embodiment, the inner tube 11, to which LNG at a cryogenic temperature is supplied from the LNG header tank 12, is covered for the required upper portion thereof with the heat insulator 17 to prevent lowering of the temperature of NG near the NG exit disposed in adjacent therewith.

Referring more specifically, in the open rack type evaporating device having the constitution as shown in FIG. 5, the temperature of NG is not lowered near the upper end of the inner tube 11 but is elevated as far as a temperature approximate to that of sea water as shown in FIG. 11.

EXAMPLE 5

Figure 6:
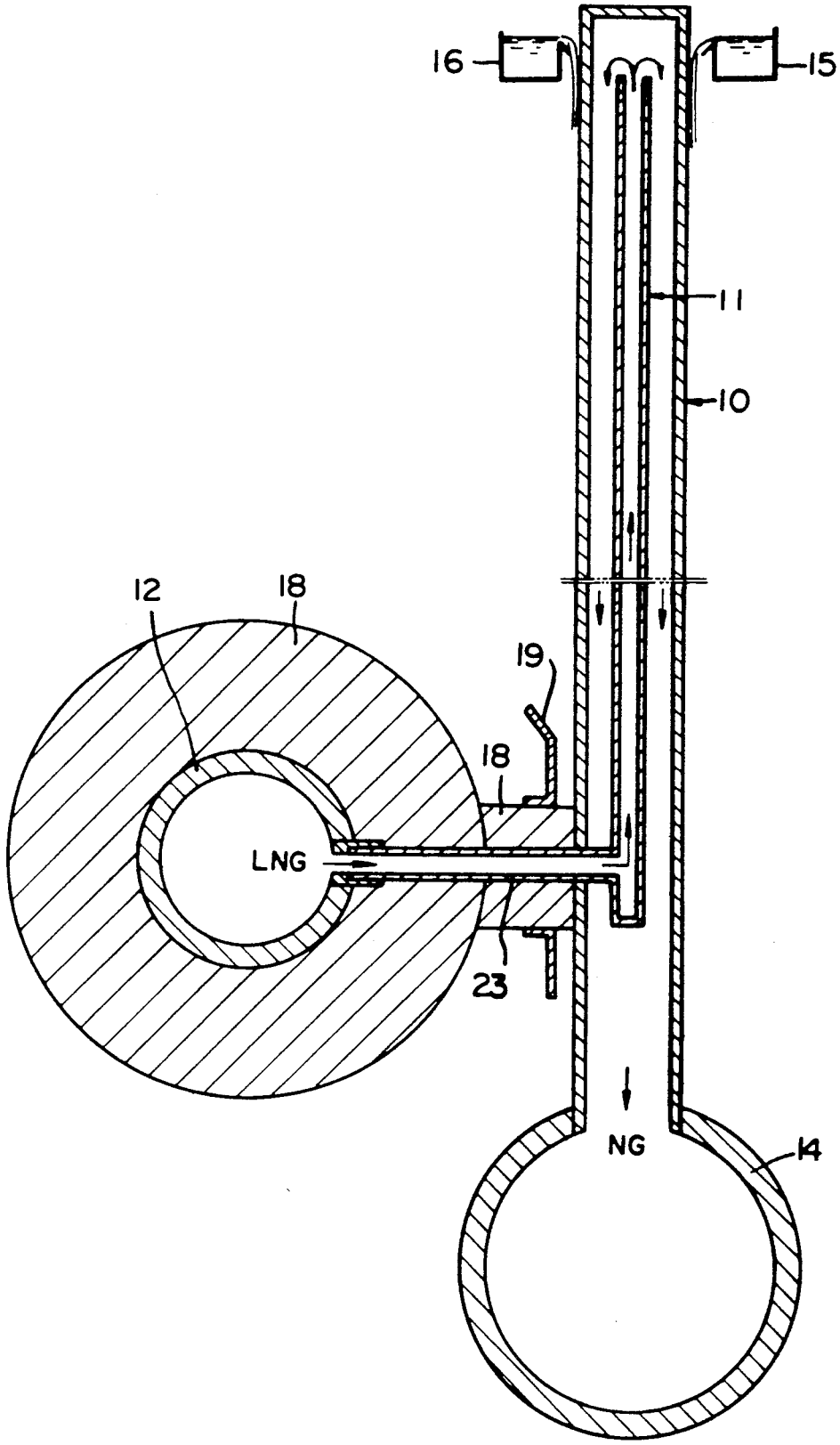

FIG. 6 shows another embodiment of a double-walled tube type open rack evaporating device according to the present invention, in which a heat-exchanging panel having the same constitution as that previously described with reference to FIG. 5 is disposed upside-down, that is, an NG exit header tank 14 is disposed at the lower end of the panel, while no header tanks are disposed at all near the water spray troughs 15, 16 disposed in the upper portion of the panel.

LNG supplied is partially evaporated under heating with NG to be described later while it uprises from the inlet header tank 12 in the inner tube 11 till it leaves the upper end opening of the inner tube 11 and reverses its flowing direction in the upper end of the outer tube 10.

The partially evaporated LNG is further heated while it flows downwardly through an annular passage between the outer tube 10 and the inner tube 11 and it is then delivered by way of an NG exit header tank 14 as NG at a normal temperature.

Since the heat-exchanging panel havin the same constitution as that shown in FIG. 1 is used upside-down, substantially the same effects can be obtained.

EXAMPLE 6

Figure 7:
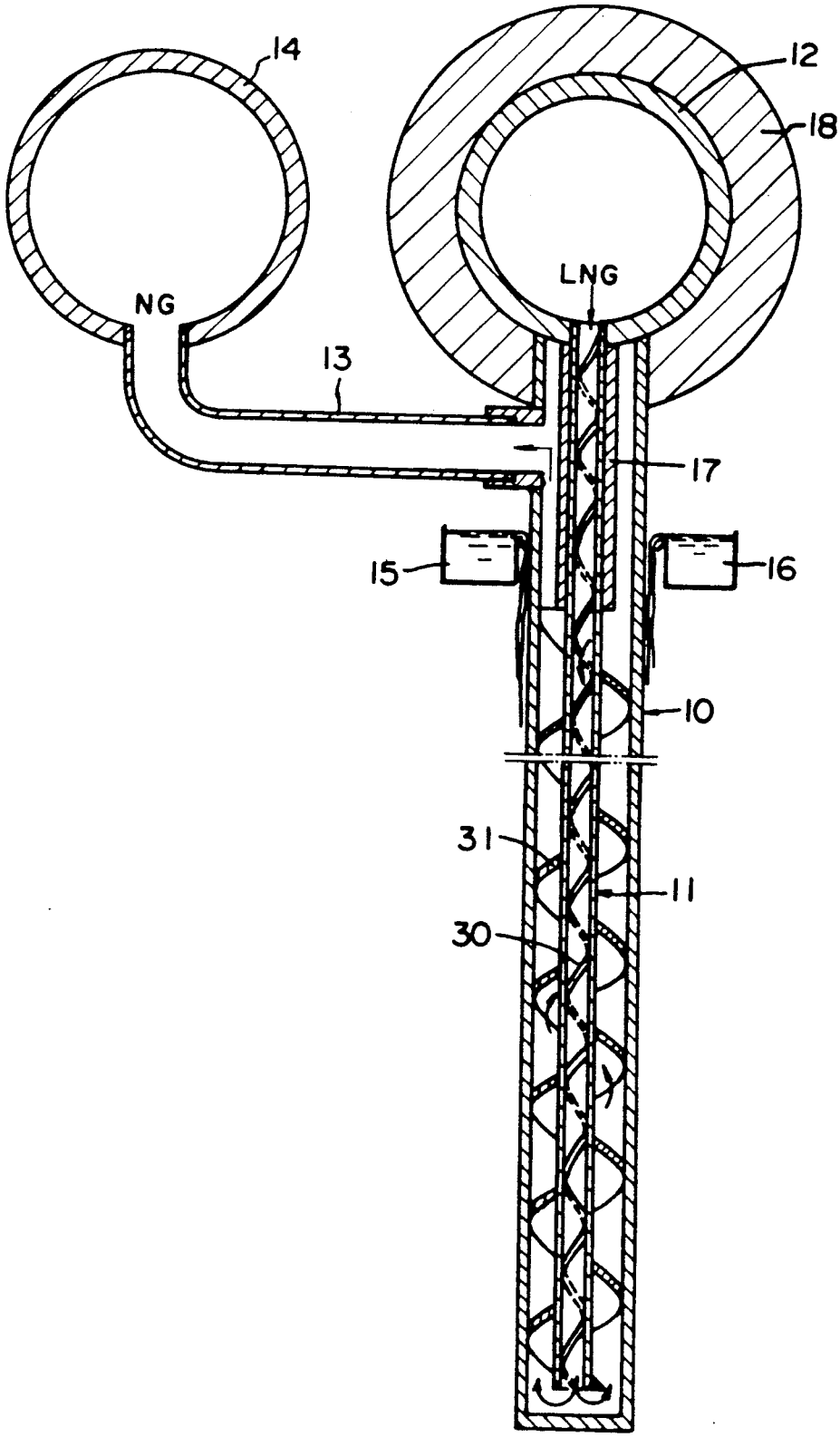

FIG. 7 shows a double-walled tube type open rack evaporating device as a further preferred embodiment according to the present invention, in which a plurality of heat-exchanging pipes each of a double-walled tube structure are arranged in parallel to constitute a heat-exchanging panel disposed vertically. An LNG inlet header tank and an NG exit header tank are disposed above the panel 1.

Each of the heat-exchanging pipes has an outer tube 10 of predetermined length and inner diameter and closed at a lower end and an inner tube 11 inserted therein, in which the lower end opening of the inner tube 11 is situated to the inner bottom of the outer tube 10, while the upper end of the inner tube 11 is connected with an LNG inlet header tank 12 for allowing LNG to be introduced and flow downwardly, and the upper end of the outer tube 10 is closed by the header tank 12.

A ribbon-shaped heat conduction promoter 30 having a predetermined twisting is inserted into the inner tube 11, and a spiral heat conduction promoter 31 with a predetermined pitch is inserted into an annular passage between the inner pipe 11 and the outer tube 10.

An NG exit header tank 14 is disposed by way of an NG exit pipe 13 connected to the outer tube 10 below the LNG inlet header tank 12.

Water overflown from water spray troughs 15, 16 opposed to each other below the NG exit pipe 13 and below the LNG inlet header tank 12 on the opposite side to the outer surface for each outer tube 10 constituting the heat-exchanging panel.

Further, the inner tube 11 is covered with a heat insulator 17 at its outer circumferential surface over a predetermined length from the junction with the LNG inlet header tank 12 to a position below the water spray troughs 15, 16 below the NG exit pipe 13.

LNG supplied is partially evaporated under heating with NG to be described later while it flows downwardly from the inlet header tank 12 through the inner tube 11 till it leaves the lower end opening of the inner tube 11 and reverses its flowing direction at the inner bottom of the outer tube 10.

The partially evaporated LNG is heated further during its uprising through an annular passage between the outer tube 10 and the inner tube 11 and it is delivered by way of the NG exit pipe 13 connected with the upper portion of the outer tube 10 to the NG exit header tank 14 as NG at a normal temperature.

In the open rack type evaporating device of this embodiment, since the heat-exchanging pipe is constituted with a double-walled tube, sea water as a heat medium and LNG at a cryogenic temperature conduct heat exchange not directly but by way of NG in the annular passage and, accordingly, ice deposition to the surface of the outer tube 10 can be reduced and the size of the evaporating device can be decreased due to the increase of the heat conduction area.

Accordingly, since the ice deposition is reduced, the amount of sea water as the heat medium to be supplied can be decreased, which enables to remarkably save the amount of electric power consumed by sea water pumps.

Further, since the LNG inlet header tank 12 for supplying LNG at a cryogenic temperature is situated higher than the troughs 15, 16, it is possible to hinder the heat of sea water from intruding to the LNG inlet header tank 12, and the flow rate hunting and calorie hunting to each of heat exchanging pipes can be prevented.

By inserting the heat conduction promoters 30, 31 respectively into the inner tube 11 and the outer tube 10, agitation and turbulence can be caused to the fluid passing through the tubes, so that heat conductivity between LNG in the inner tube 11 and NG in the outer tube 10 can be improved remarkably. Further, by making a difference in the performance between the heat conduction promoters 30 and 31 at the inside and the outside of the inner tube 11, for example, by changing the twisting or pitch, NG in the outer tube 10 can be set to a required temperature thereby preventing the ice deposition to the surface of the outer tube 10.

Further, since the heat-exchanging pipe is constituted with a double-walled pipe, NG can be supplied in a U-shaped flow in which NG is supplied from the lower end of the inner tube 11 into the outer tube 10, uprises in the pipe and then exits externally from the upper end, so that a pressure loss in the pipe is increased to stabilize the gas flow.

Furthermore, in the open rack type evaporating device of this embodiment, the inner tube 11 to which LNG at a cryogenic temperature is supplied from the LNG header tank 12 is surrounded for the required upper portion thereof with the heat insulator 17 to prevent lowering of the temperature of NG near the NG exit disposed in adjacent therewith.

Referring more specifically, in the open rack type evaporating device having the constitution as shown in FIG. 7, the temperature of NG is lowered near the NG exit pipe 13 when the insulator 17 disposed for the required upper portion of the inner tube 11 is removed as shown in FIG. 10, whereas the temperature of NG is elevated as far as a temperature approximate to that of sea water if the insulator 17 is covered as shown in FIG. 11.

EXAMPLE 7

Figure 8:
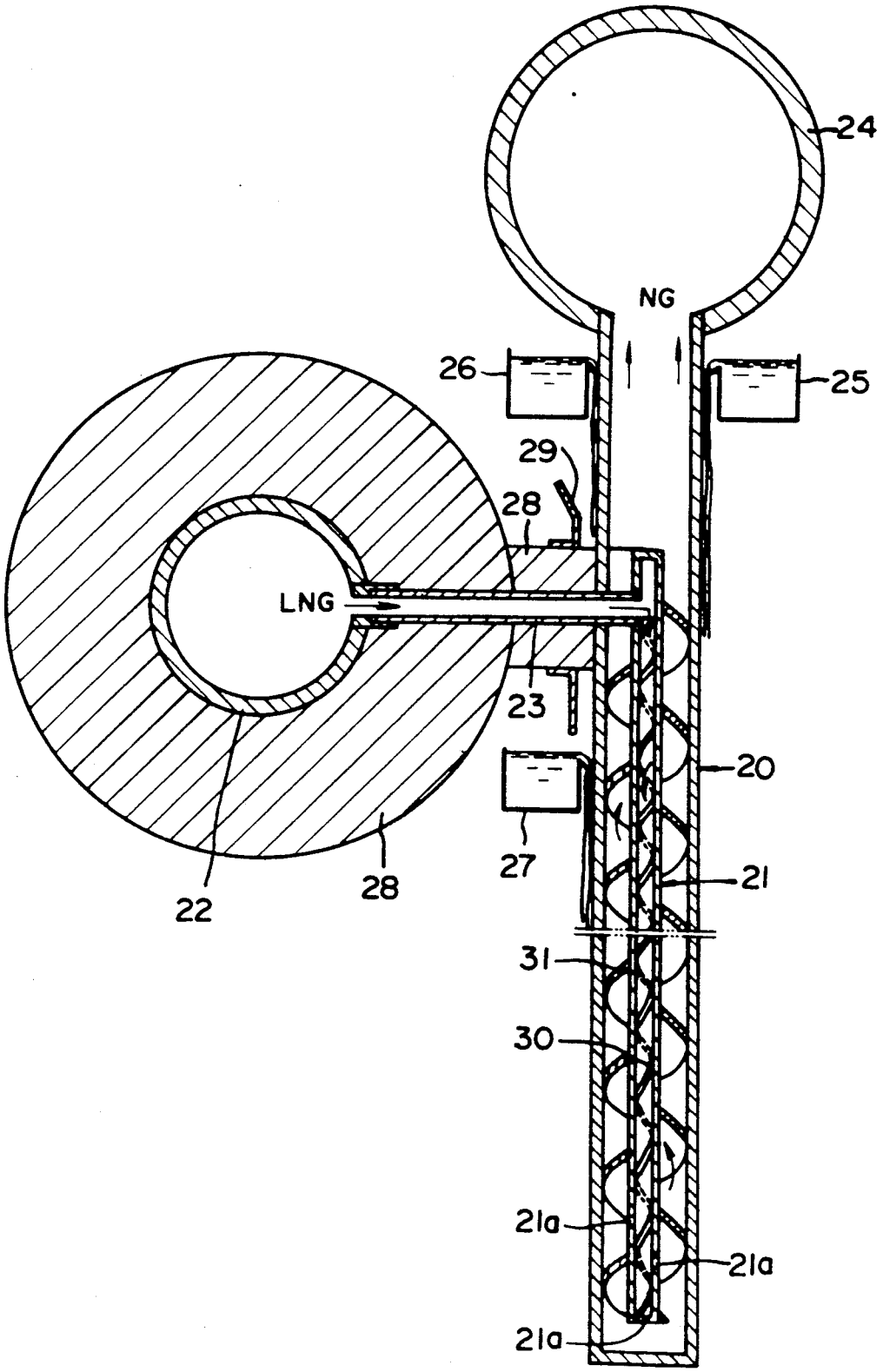

FIG. 8 shows a double-walled tube type open rack evaporating device as a further embodiment according to the present invention, in which a plurality of heat-exchanging pipes each of a double-walled tube structure are arranged in parallel to constitute a heat-exchanging panel disposed vertically. An LNG inlet header tank and an NG exit header tank are disposed above the panel 1.

In each of the heat-exchanging pipes, an inner tube 21 shorter than an outer tube 20 is inserted into the latter pipe 20 of predetermined length and inner diameter and closed at the lower end, in which the closed lower end of the inner tube 21 is situated to the inner bottom of the outer tube 20. Further, small apertures 21*a* each of predetermined inner diameter are disposed to the lower portion of the inner tube 21 with area of disposition, pitch and number being optionally selected. The upper end of the inner tube 21 is situated below and being spaced apart by a required distance from the upper end of the outer tube 20, and the upper end of the outer tube 20 is connected with the NG exit header tank 24, so that NG can be delivered.

A ribbon-shaped heat conduction promoter 30 having a predetermined twisting is inserted into the inner tube 21, and a spiral heat conduction promoter 31 with a predetermined pitch is inserted into an annular passage between the inner tube 21 and the outer tube 20.

An LNG inlet header tank 22 is disposed at a predetermined position below the NG exit header tank 24 by way of an LNG inlet pipe 23 connected passing through the outer tube 20 to the upper portion of the inner tube 21.

The LNG inlet pipe 23 and the LNG inlet header tank 22 are entirely covered with a heat insulator 28.

Water overflown from water spray troughs 25, 26 disposed opposed to each other below the NG exit header tank 24 flows downwardly to the outer surface of each of the outer tubes 20 constituting the heat-exchanging panel, while water overflown from a water spray trough 27 also flows below the LNG inlet pipe 23.

Further, a scattering preventive plate 29 is disposed circumferentially on the heat insulator 28 for the LNG inlet pipe 23 such that water overflown from the water spray trough 26 below the NG exit header tank 24 is not sprayed on the side of the LNG inlet header tank 22.

LNG supplied is introduced from the inlet header tank 22 by way of the LNG inlet pipe 23 into the inner pipe 21, caused to flow downwardly in the pipe 21 and then evaporated under heating with NG uprising through the annular passage between the outer tube 20 and inner tube 21. Since LNG in the inner tube 21 and NG in the outer tube 20 are mixed directly by way of the small apertures 21*a* disposed in the lower portion of the inner tube 21, and efficient heat exchange can be conducted by the heat conduction promoters 30, 31 disposed to the inside and the outside of the inner pipe 21 to provide advantages, for example, of making the heat exchanging pipe shorter and smaller.

The thus obtained NG at a low temperature is further heated while it uprises through the annular channel between the outer tube 20 and the inner tube 21, further uprises beyond the upper end of the inner tube 21 and is then delivered to the NG exit header tank 24 connected with the upper end of the outer pipe 20 as NG at a normal temperature.

Further, in the open rack type evaporating device in this embodiment, the NG exit header tank 24 is disposed spaced apart above by a predetermined distance from the upper end of the inner tube 21, to which LNG at a cryogenic temperature is supplied from the NG inlet header tank 22, so that heat exchange is not taken place, even indirectly, with respect to LNG at a cryogenic temperature to prevent the lowering of the NG temperature.

EXAMPLE 8

Figure 9:
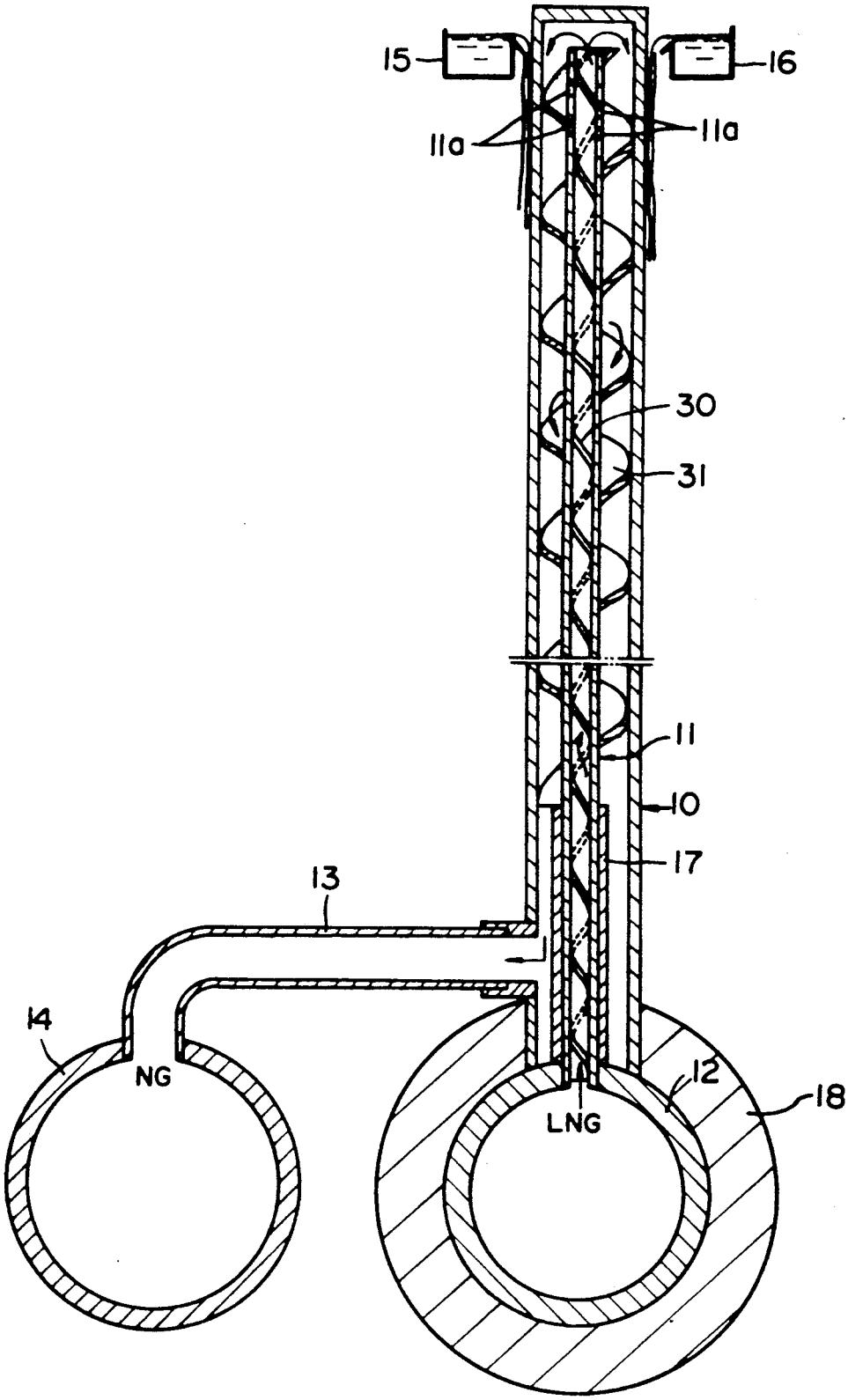

FIG. 9 shows a still further embodiment of a double-walled tube type open rack evaporating device according to the present invention. In this embodiment, a heat-exchanging panel having same constitution as that previously described with reference to FIG. 7 is disposed upside-down such that an LNG inlet header tank 12 is disposed at the lower end of the panel, an NG exit header tank 14 is also disposed therealong and no header tanks are disposed at all near water spray toughs 15, 16 disposed in the upper portion of the panel.

LNG supplied uprises from the inlet header tank 12 through the inner tube 11 incorporating a heat conduction promoter 30, in which LNG in the inner tube 11 and NG in the outer tube 10 are mixed directly by way of small apertures 11*a* disposed in the upper portion of the inner tube 11, so that heat-exchange can be conducted efficiently to obtain the similar effects as described with respect to the embodiment shown in FIG. 7.

What is claimed is:

1. A double-walled tube open type rack evaporating device comprising a plurality of heat-exchanging pipes, each of a double-walled tube structure having an inner tube and an outer tube in communication with said inner tube at one end to constitute a heat-exchanging panel, a heat insulating means positioned around a portion of the length of each said inner tube, a liquified gas inlet header tank connected to one end of said inner tube, an exit header tank connected to one end of said outer tube, and a heating means for gradually evaporating a liquified gas that flows from said liquified gas inlet header tank into said inner tube and then delivering the gas as a gas at a normal temperature to said exit header tank.

2. A double-walled tube type open rack evaporating device wherein a plurality of heat-exchanging pipes, each of a double-walled tube structure, are disposed in parallel to constitute a heat-exchanging panel, a heat insulating means positioned around a portion of the length of each said inner tube, and a water spray trough is disposed to the upper portion of said panel for enabling heating, a liquified gas is introduced from an inlet header tank disposed on the side of the upper or the lower end of the heat-exchanging pipe into an inner tube, a fluid leaving the inner tube can reverse its direction in an outer tube closed at the other end on the side opposite to the inlet header tank, heat-exchange is made possible between a fluid flowing upwardly or downwardly through an annular passage between the outer tube and the inner tube after reversing its direction and sprayed water at the outer surface of the outer tube and the liquified gas in the inner tube, and the gas evaporated and heated can be delivered from an exit header tank connected to the outer tube on the side of the inlet header tank.

3. A double-walled tube type open rack evaporating device as defined in claim 2, wherein said heat insulating means is disposed to the outer circumferential surface of the inner tube on the side of the inlet header tank including the vicinity of the delivery port to the exit header tank.

4. A double-walled tube type open rack evaporating device, wherein a heat-exchanging panel is formed by disposing a plurality of heat-exchanging pipes, each of a double-walled tube structure, in parallel, in which an inner tube shorter than an outer tube is coaxially inserted into said outer tube closed at one end, each inner tube having a heat insulating means therearound, and having an exit header tank disposed at the other end thereof such that the opening end of said inner tube is opposed to the closing end of said outer tube, and the closing end of said inner tube connected with an inlet header tank is situated at a position spaced apart by a predetermined distance from said exit header tank, said heat-exchanging panel is disposed vertically with said header tank being situated above or below, and water spray troughs are disposed to the upper portion of said panel for enabling heating, a liquified gas is introduced from the inlet header tank connected to the closing end of the inner tube into the inner tube, and a fluid leaving the inner tube in the closed outer tube can reverse its direction, heat-exchange is enable between a fluid flowing upwardly or downwardly through an annular passage between the outer tube and the inner tube, and sprayed water to the outer surface of the outer tube and the liquified gas in the inner tube, and the liquified gas is delivered from the exit header tank connected with the end of the outer tube.

5. A double-walled tube type open rack evaporating device, wherein a heat-exchanging panel is formed by disposing a plurality of heat-exchanging pipes, each of a double-walled tube structure, defining an inner tube and an outer tube, in parallel, each inner tube having a heat insulating means therearound, a liquified gas inlet header tank and a liquified gas exit header tank are disposed to the outer or the lower portion of the heat-exchanging panel and a water spray trough is disposed to the upper portion of the panel, and a liquified gas is caused to flow from one end of the inner tube and an evaporated gas reversed its direction at the opening and of the inner tube opposed to the closing end of the outer tube is delivered by moving through an annular passage between the outer tube and the inner tube, in which, a heat conduction promoter is inserted to either of the inner tube and the annular passage.

6. A double-walled tube type open rack evaporating device, wherein a heat-exchanging panel is formed by disposing a plurality of heat-exchanging pipes, each of a double-walled tube structure, defining an inner tube and an outer tube, in parallel, each inner tube having a heat insulating means therearound, a liquified gas inlet header tank and a liquified gas exit header tank are disposed to the outer or the lower portion of the heat-exchanging panel and a water spray trough is disposed to the upper portion of the panel, and a liquified gas is entered from one end of the inner tube, enabling gas-liquid mixing in the outer tube by means of small aperatures disposed to the outer circumference of the other closing end of the inner tube, and the liquified gas is delivered by passing through an annular passage between the outer tube and the inner tube, in which a heat conduction promoter is inserted to either of the inner tube and the annular passage.

* * * * *